United States Patent [19]

De Waele

[11] 4,425,748

[45] Jan. 17, 1984

[54] BUILDING BLOCK SET AND METHOD FOR BUILDING WITH SUCH A BLOCK SET

[75] Inventor: Gérard De Waele, Heldergem, Belgium

[73] Assignee: Hanota Holdings S.A., Luxemburg, Belgium

[21] Appl. No.: 189,830

[22] Filed: Sep. 23, 1980

Related U.S. Application Data

[63] Continuation of Ser. No. 830,095, Sep. 2, 1977, Pat. No. 4,237,670.

[30] Foreign Application Priority Data

| | | | |
|---|---|---|---|
| Sep. 2, 1976 | [BE] | Belgium | 170293 |
| Nov. 16, 1976 | [BE] | Belgium | 172389 |
| Dec. 13, 1976 | [BE] | Belgium | 173192 |
| Mar. 1, 1977 | [BE] | Belgium | 175359 |

[51] Int. Cl.[3] ..... E04B 2/54

[52] U.S. Cl. ..... 52/436

[58] Field of Search ..... 52/607, 603, 604, 605, 52/429, 430, 433, 439, 608, 609

[56] References Cited

U.S. PATENT DOCUMENTS

| | | | |
|---|---|---|---|
| 778,598 | 12/1904 | McGuire | 52/439 |
| 1,397,035 | 11/1921 | Colosimo | 52/595 |
| 1,704,255 | 3/1929 | Lewis | 52/442 |
| 1,959,816 | 5/1934 | Crum | 52/606 |
| 2,028,997 | 1/1936 | Schmitz | 52/606 |
| 2,172,051 | 9/1939 | Robbins | 52/606 |
| 2,176,986 | 10/1939 | Briscoe | 52/439 |
| 2,881,614 | 4/1959 | Preininger | 52/608 |
| 2,958,983 | 11/1960 | Hoover | 52/396 |
| 2,994,162 | 8/1961 | Frantz | 52/608 |
| 3,233,379 | 2/1966 | Zagray | 52/396 |
| 3,378,969 | 4/1968 | Larger | 52/396 |

FOREIGN PATENT DOCUMENTS

| | | | |
|---|---|---|---|
| 673326 | 6/1964 | Belgium | 52/606 |
| 839408 | 5/1952 | Fed. Rep. of Germany . | |
| 1184597 | 7/1959 | France . | |
| 818982 | 8/1959 | United Kingdom | 52/433 |

*Primary Examiner*—John E. Murtagh

*Attorney, Agent, or Firm*—Weiser & Stapler

[57] ABSTRACT

There is described a building block set which comprises at least two block types formed by base blocks and/or joined base blocks comprised of a united combination of identical or different base blocks, a first base block having a portion in the shape of a straight rectangle parallelepiped which is extended at the one end thereof by two flanges each extending in the extension of a side surface or said portion over a distance substantially equal to a fraction of the length of said portion, the parallelepiped-shaped portion having a hollow volume extending through the block over the whole height thereof, a second base block the horizontal cross-section of which is fork-shaped, particularly U-shaped, the flange length of said second block being substantially equal to the flange length of the first base block, the tolerances allowed for the above-defined lengths and distances being substantially equal to the thickness of the walls of the parallelepiped-shaped portion, the lower and upper edges of each block type being substantially flat to allow laying the blocks without anchoring on top of one another in any relative position whatsoever.

23 Claims, 19 Drawing Figures

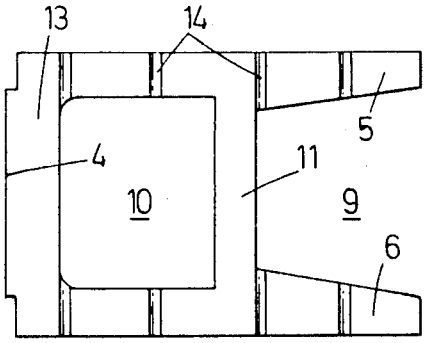
FIG. 4.
FIG. 5.
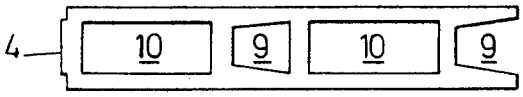
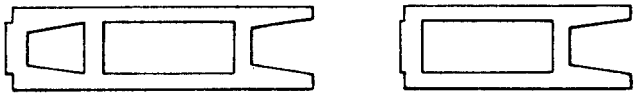
FIG. 6
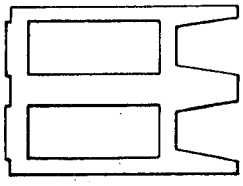
FIG. 7
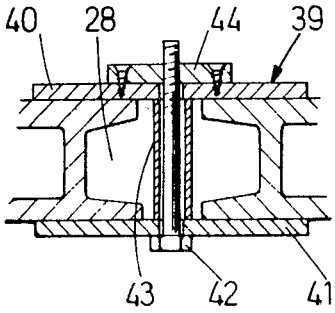
FIG. 18
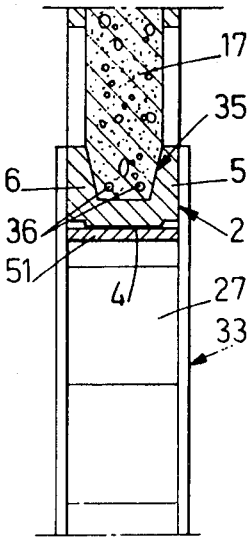
FIG. 17

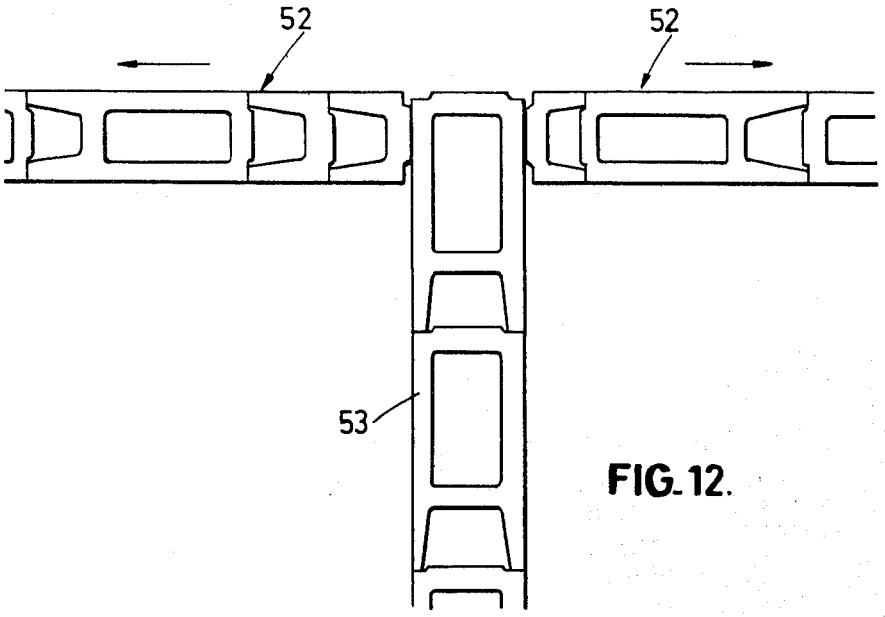
FIG. 12.
FIG. 19.
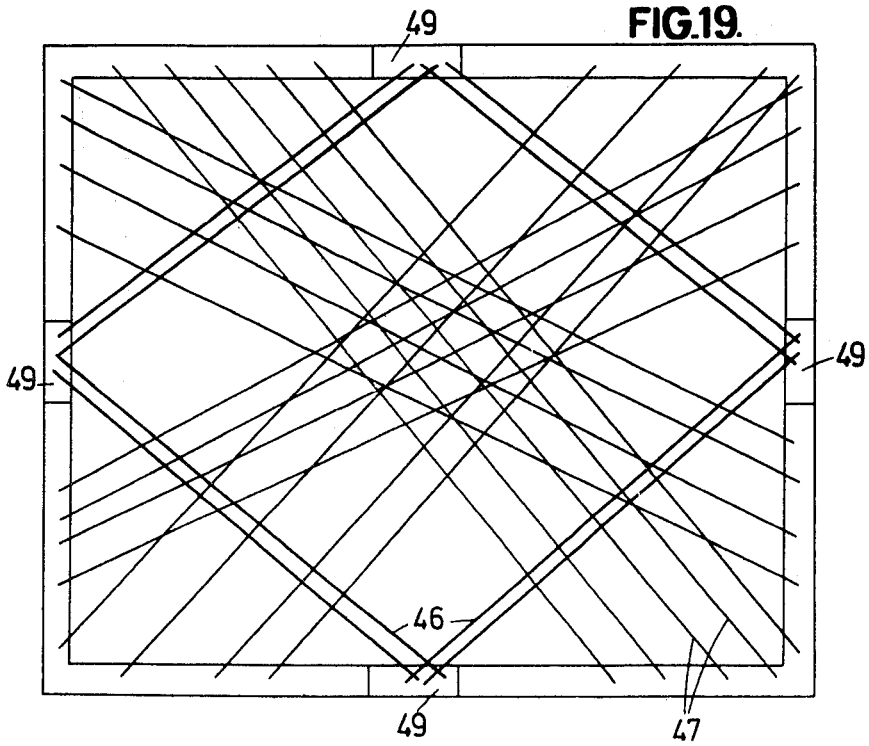

BUILDING BLOCK SET AND METHOD FOR BUILDING WITH SUCH A BLOCK SET

This is a continuation of application Ser. No. 830,095, filed Sept. 2, 1977, now U.S. Pat. No. 4,237,670.

This invention relates to a set of building blocks comprising hollow blocks which can be dry-assembled and inside which a binder notably concrete can be poured.

The principle of dry-laying rows of hollow blocks, arranged on top of one another and the filling of said blocks by means of concrete to make same integral is known for ages and there are a very high number of patents relating to building blocks of special shape for the application of such a principle.

However in practice it has been noticed that the art of dry-laying hollow blocks and filling same with concrete has found little application and is generally limited to underground masonry for which the requirements from an accuracy and aesthetic consideration are less stringent than for visible masonry.

This invention has for object to provide a set of building blocks which allows to extend the art of dry-laying as defined above to visible or above-ground masonry to make any construction such as houses with or without upper storeys, industrial buildings, etc, in a very rational and economically-viable way.

A deep study of the dry-laying art has led to the conclusion that at least four conditions are to be met if such an art is to be substituted to the conventional masonry according to which the blocks are bound together with mortar. Said conditions are as follows:

(1) it should be possible to lay loosely at least five rows of blocks with a height of 20 cm on top of one another with enough stability to be able to fill same in one operation with concrete, without requiring the use of an inner reinforcement to avoid the blocks breaking under the pressure resulting from the concrete drop, so as to make the method industrially competitive with the conventional masonry methods.

(2) the complete filling with concrete should be insured and there can be no slits either in the vertical direction or in the horizontal direction, between the blocks after such filling, in such a way that the blocks should be bound both through the cross-wise walls thereof and through the horizontal walls thereof by means of the filling concrete in whatever structure of walls or wall combination.

(3) all of the wall combinations which can occur in a structure, such as corner junctions, T-shape junctions and X-shape junctions, should be possible with but a minimum number of different blocks and this independently of the size and relative positions of the wall parts and of the wall thicknesses.

(4) the shape of the blocks should be as simple as possible to be manufacturable with enough accuracy (as small as possible a tolerance), on an industrial scale and with a large enough throughput capacity. Moreover, the block shape should be such that the blocks have sufficient mechanical strength to allow same to be handled and conveyed with conventional means.

A construction block which does not fulfill even but one of the above conditions, is not suitable for the application of the dry-laying art on location and thus does not have any practical value for the object as contemplated by the present invention.

It has been noticed that with the known building blocks as defined above, at least one of the above conditions is not fulfilled.

The most usual problems which occur with the known blocks appear to be the danger of breaking when pouring the concrete and the impossibility of making all of the wall combinations which can be encountered in a conventional structure with a minimum number of different block types (conditions 1 and 3).

The invention lies in providing a set of building blocks in which a number of specific features are combined, some of which are possibly applied singly on known blocks, which allow due to the interaction thereof to fulfill the recited conditions and thus to bring a solution to the art of dry-laying as defined above in all of the conditions which can occur when erecting buildings.

For this purpose the block set comprises at least two block types formed by base blocks and/or joined base blocks comprised of a united combination of identical or different base blocks, a first base block having a portion in the shape of a straight rectangular parallel piped which is extended at the one end thereof by two flanges each extending in the extension of a side surface of said portion over a distance substantially equal to a fraction of the length of said portion, the parallelipiped-shaped portion having a hollow volume extending through the block over the whole height thereof, a second base block the horizontal cross-section of which is fork-shaped, particularly U-shaped, the flange length of said second block being substantially equal to the flange length of the first base block, the tolerance allowed for the above-defined lengths and distances being substantially equal to the thickness of the walls of the parallelepiped-shaped portion, the lower and upper edges of each block type being substantially flat to allow laying the blocks without anchoring on top of one another in any relative position whatsoever.

Advantageously that parallelepiped-shaped portion of the first base block is provided at the end thereof opposite to the one bearing the flanges, with an overthickness which is fittable between the free ends of another block flanges, the back of the second U-shaped base block being provided with an overthickness similar to the overthickness of said first block, to allow forming an anchoring between two blocks laid in extension of one another, said overthickness being so designed that a free space in which the binder can flow remains between the flanges of the one block and the overthickness of another block cooperating with said flanges.

The invention also relates to a particular building method making use of said block set.

Said method which lies in first laying blocks loosely on top of one another and next to one another to form walls through which extend downwards shafts and then pouring the binder in the hollow block spaces of the top row to fill said shafts, comprises arranging the blocks relative to one another so as to form vertical shafts which at least every third block row open sidewise towards an adjacent shaft, along a continuous slanting channel letting the binder fed to the shaft concerned flow out partly by overflowing substantially under the weight thereof, towards the adjacent shaft or shafts which are not yet filled with binder, with such a speed and flow rate which are at most equal to the allowable speed and flow rate as determined by the block pressure strength.

In a particular embodiment of said method, the blocks of the first base type are laid in rows on top of one another in such a way that the flanges thereof be facing in the same direction of one and the same wall portion and a specific block in a row be laid in a recessed position relative to that block on which it bears mainly in the preceding row, over a distance which is substantially equal to the flange length of said block in said row, the blocks of the second base type being substantially used for starting walls or wall portions so as to allow adjusting the laying of the first-type blocks in the above-described way and at the ends of walls or wall portions to terminate same substantially vertically, base blocks may be replaced by jointed base blocks.

Other details and features of the invention will stand out from the description given below by way of non limitative example and with reference to the accompanying drawings in which:

FIGS. 4 to 7 show other variations of united combinations of blocks according to FIG. 1.

FIGS. 11 and 12 show plan views of specific junctions of wall portions.

FIG. 17 is a cross-section view along line XVII-XVII in FIG. 16.

FIG. 18 is a cross-section view along line XVIII-XVIII in FIG. 16.

FIG. 19 is a diagrammatic plan view of a floor born by walls obtained by the method according to the invention.

In the various figures, the same reference numerals pertain to similar elements.

There should first be noted that even if the lower and upper surfaces of the blocks in some particular set should be as smooth and flat as possible and in parallel relationship with one another, while lying at right angle to the side surfaces thereof, the tolerances allowed for the block and block portion lengths correspond substantially to the thickness of the walls thereof. This will appear more clearly from the description given hereinafter of the building method with the use of such blocks.

Figure 1:
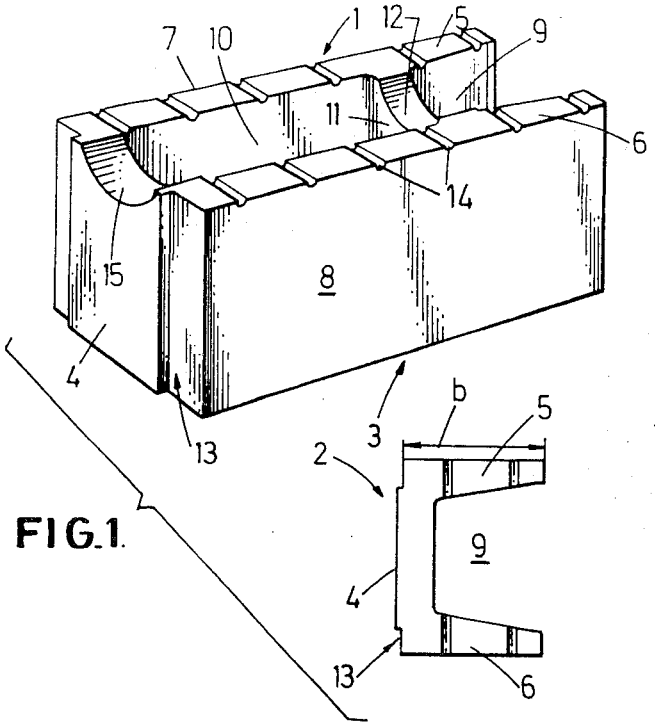
FIG. 1 shows a block set according to a first embodiment of the invention.

FIG. 1 shows a building block set that comprises two types of base blocks 1 and 2. The first type is comprised of a block 1 having a portion 3 in the shape of a straight rectangular parallelepiped which is extended at the one end thereof with two flanges 5 and 6 which extend each in the extension of the one side surface, 7 and 8 respectively, over a distance which is substantially equal to a fraction of the length of said portion 3 which in the embodiment as shown in FIG. 1, is one half of said length. The other end of block 1 is provided with an overthickness 4 which is fittable between the free ends of flanges 5 and 6 of another block.

That portion in the shape of a parallelipiped has a hollow space 10 having as large a horizontal cross-section as possible, also in the shape of a parallelipiped, which goes through the block over the whole height thereof, said block thus being open on both bottom and top surfaces.

The second type of blocks 2 is in the shape of a "U", the back 13 of which is provided with an overthickness similar to the one of the block 1 and with the length of the flanges 5 and 6 substantially equal to the one of the flanges 5 and 6 of block 1. The side surfaces 7 and 8 as well as the outer surfaces of the flanges 5 and 6 are substantially flat to allow building walls both sides of which are substantially flat.

The bottom and top edges of each block type are substantially flat and in parallel relationship with one another, so as to allow laying the blocks on top of one another in any relative position whatsoever.

The invention also relates to a block set which comprises a jointed combination of blocks of one and the same base type or from two different base types.

Figure 2:
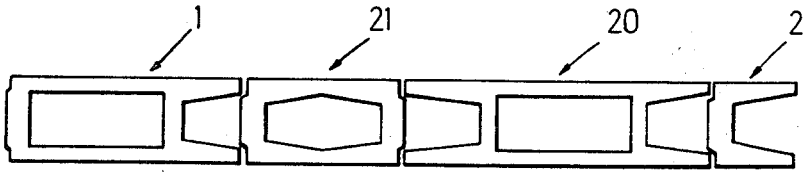
FIG. 2 is a plan view on a smaller scale of a block set according to a second embodiment of the invention.

Such embodiments have been shown in FIGS. 2, 4, 5, 6 and 7. FIG. 2 shows base blocks 1 and 2 which are associated by way of example, to blocks 20 and 21. Block 20 can be considered as a combination of a block 1 with a block 2, while block 21 can be considered as a combination of two blocks 2 with the ends of flanges 5 and 6 joined to form an unit.

FIG. 4 shows the association in the same direction of two blocks 2. FIG. 5 shows a block comprised of two blocks 1. FIG. 6 shows a set of blocks 1 with a block comprised of the association of one block 1 with a block 2. Finally FIG. 7 is a combination of two blocks 1 laid side to side.

It must be understood that other combinations are possible. It is for instance possible to provide combinations of two or more blocks 1, etc.

Figure 3:
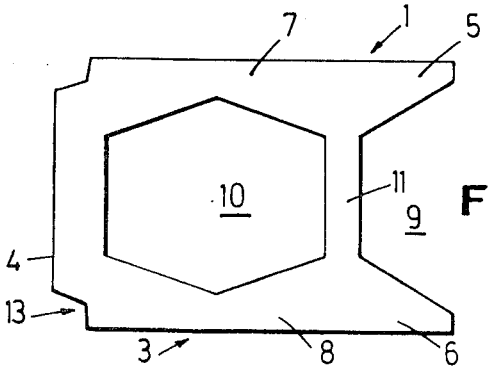
FIG. 3 is a plan view of a particular block type of a set according to the invention.

FIG. 3 shows a variation of a relatively large block 1 which is mostly useful when making foundation walls.

To avoid any danger of breaking such large blocks when filling same with a binder, normally concrete, the inner corners of portion 3 in the shape of a parallelipiped are reinforced. For this purpose according to the invention, the side walls of 7 and 8 of portion 3 are preferably widened on the inner side thereof towards the adjacent corners as clearly shown in FIG. 3.

Such a reinforcement is also advantageously provided on the inner side of flanges 5 and 6 and this independently from the block size. Said flanges thus get progressively wider from the free end thereof towards the bottom, so as to give a horizontal cross-section which has substantially the shape of a rectangular trapezium.

Block type 2 can comprise a purality of variations as regards the length of the flanges for making the junctions in two or more walls with the same thickness or different thicknesses.

In a particular embodiment the flange length can be subtantially equal to the sum of the flange length on the first block type 1 and of the wall thickness in portion 3 thereof.

In another particular embodiment, the flange length for block 2 is substantially equal to the length of one block 1 as measured at right angle to the flanges.

In still another embodiment of block 2, the flange length is substantially equal to the difference between the length of one block 1 and the sum of the flange length thereof and the width of one block 1.

Finally the flange length for a block 2 can also be equal to the difference between length and width of a a block 1.

To make junctions at right angle between walls with different thicknesses, it might be useful to provide blocks 2 having the width of the one wall and a flange length depending on the width of the blocks used for the other wall. Consequently, the different variations in the blocks 2 as described above can be applied to combinations of walls with different thicknesses.

In a preferred embodiment of the set as shown in FIG. 1, the length of block 1 is substantially equal to three times the width thereof.

At least one of the cross-wise walls in the blocks of the set according to the invention is provided on at least one edge thereof, with a recess.

In the block set as shown in FIG. 1, most of the blocks 1 have such a recess 12 in the cross-wise wall 11 and a similar recess 15 in wall 13. In the same way, it would be possible to provide a similar recess in the wall 13 of some of the blocks 2.

It is however of importance that all of the blocks 1 and 2 do not have a recess 15 in wall 13. For instance, the blocks to be used in right-angle corners cannot be provided with such a recess 15. To the contrary, all of the blocks can be provided with recess 12 in wall 11.

The benefit of the provision of such recesses will be defined hereinafter when describing the building method used according to the invention.

In some cases, for example for relatively wide blocks, it would even be possible to dispense with the overthickness 4. The same is true for recess 12.

Said method lies in first laying the blocks in some specific set loosely on top of one another and in the extension of one another, so as to form walls through which extend downward shafts, and pouring a binder, normally concrete, into the hollow spaces in the blocks of the top row to fill said shafts.

Figure 8:
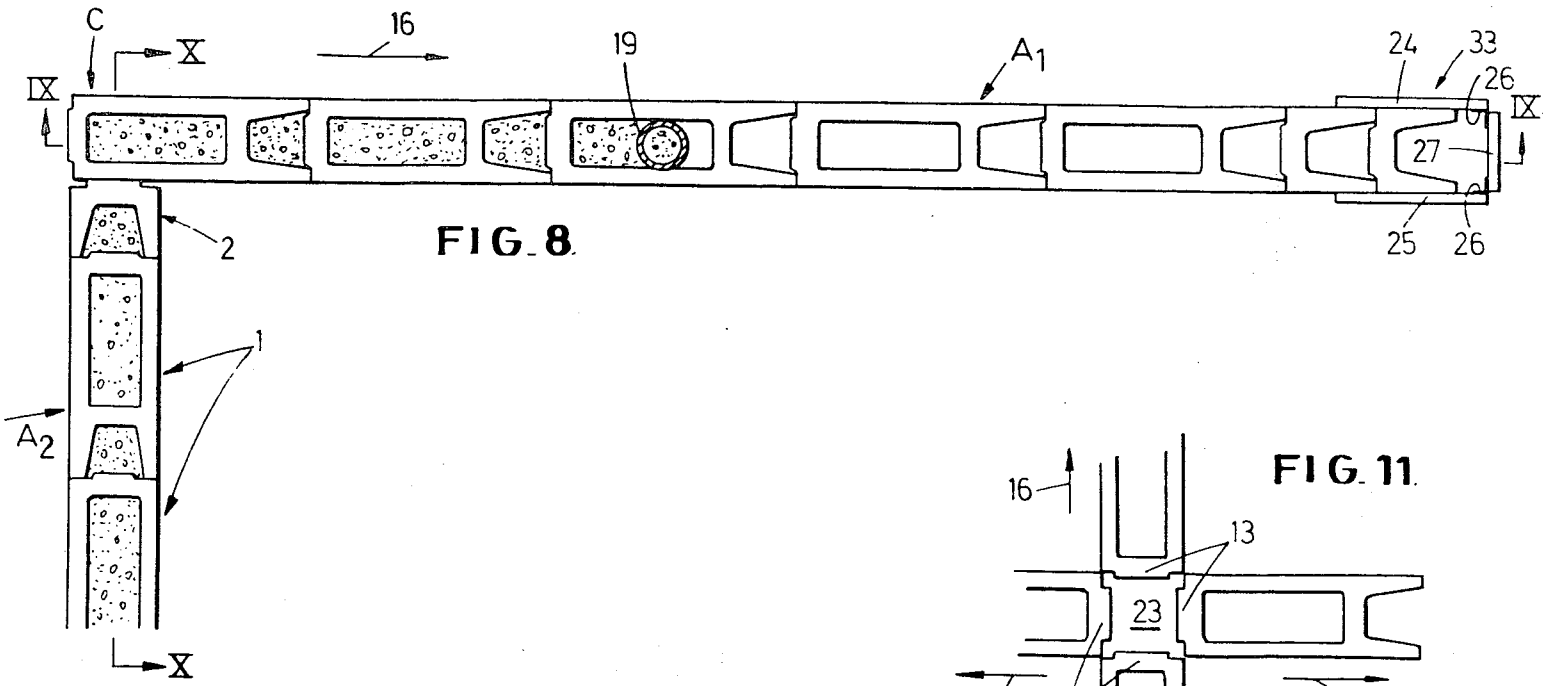
FIG. 8 is a plan view of two wall portions forming a corner.
Figure 9:
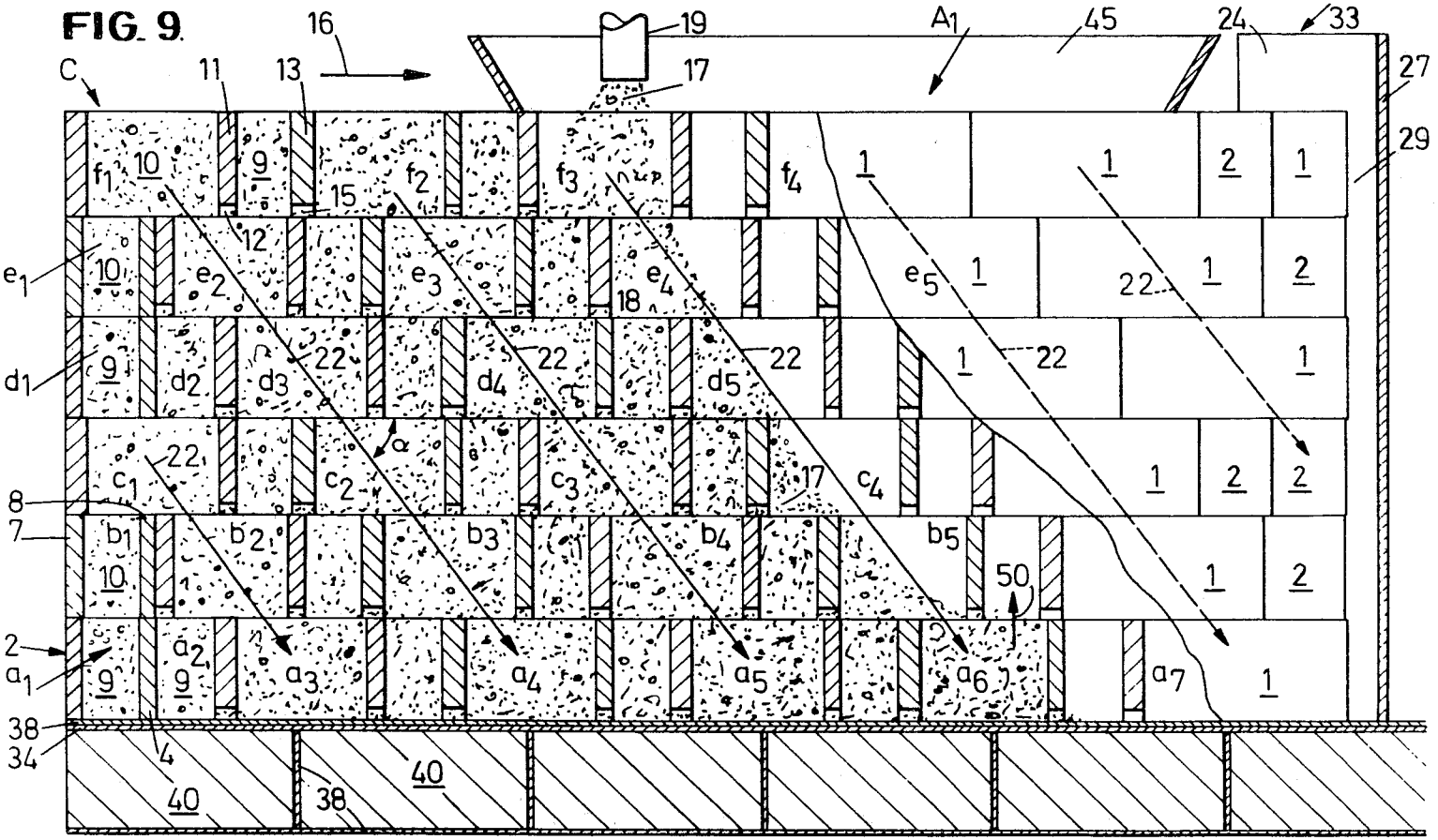
FIG. 9 is an elevation view with parts broken away and in cross-section along line IX-IX in FIG. 8.
Figure 10:
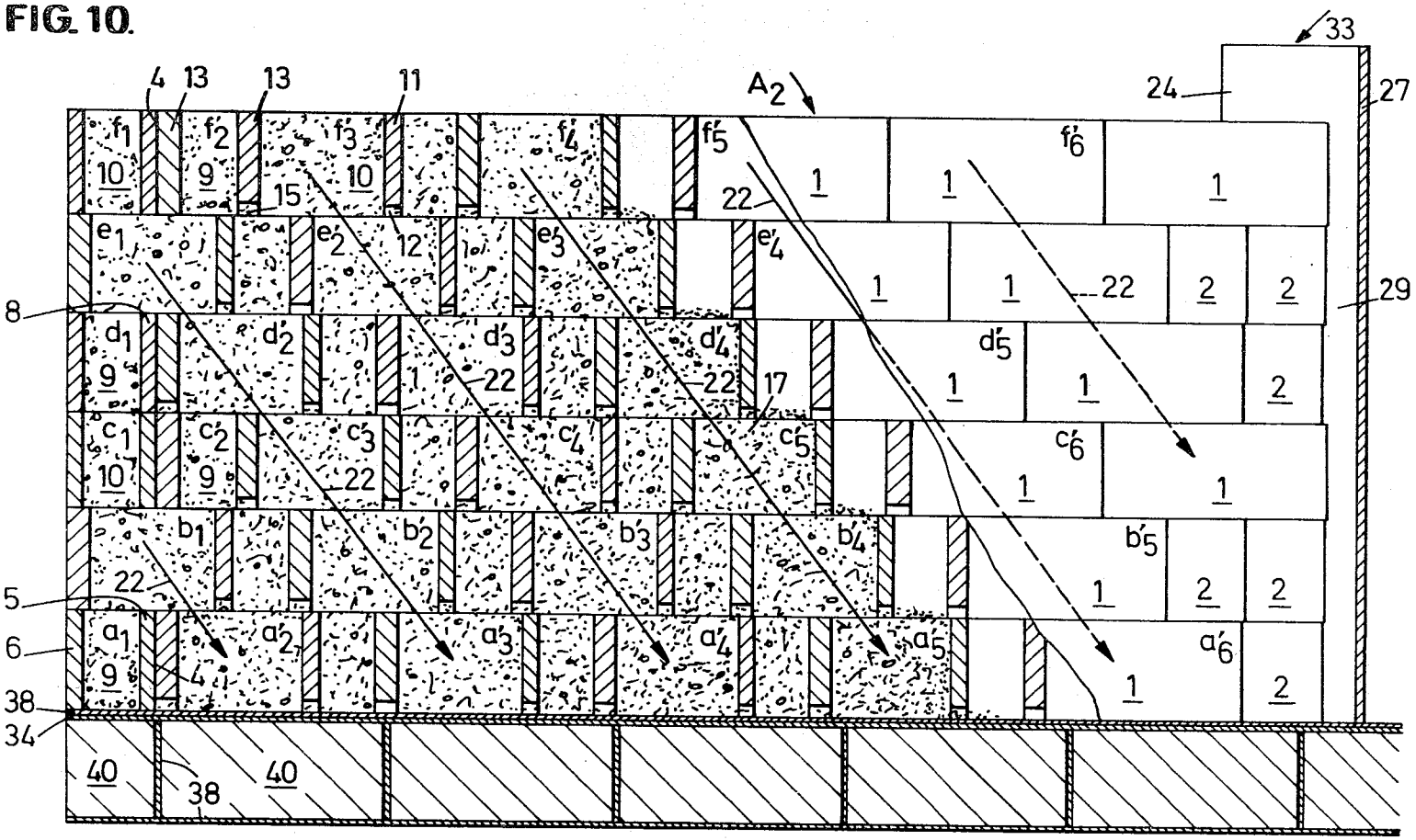
FIG. 10 is an elevation view with parts broken away and in cross-section along line X-X in FIG. 8.

Said method which is essentially shown in FIGS. 8 to 10, has for feature that the blocks are so laid relative to one another as to form vertical shafts which at least every third block row, open sidewise towards an adjacent shaft along a cntinuous slanting channel shown by arrow 22 which lets the binder in the concerned shaft escape partly by overflowing essentially under the own weight thereof, towards the adjacent shaft or shafts which are not yet filled with binder, at such a speed and with such a flow rate which are at the most equal to the allowable speed and flow rate as determined by the pressure strength of the blocks.

The relative size of the blocks and the bond used to lay same are preferably so that the channels have a slanting relative to the horizontal in the range from 50° to 60°.

Moreover the blocks are arranged relative to one another in such a bond that underneath a hollow space 10 in the parallelepiped-shaped portion 3 of a block 1 is formed a stepped channel 22 as determined by flanges 5 and 6 of the blocks used, in such a way that when pouring the binder, a cascade action is obtained allowing to lower the fall speed and the flow rate of the binder passing through said channels in sequence from one shaft to another.

FIGS. 8 to 10 show the construction of a corner between two wall portions $A_1$ and $A_2$ made by means of a set of base blocks 1 and 2 as shown in FIG. 1. Blocks 1 have for dimensions 14×20×39 cm, while blocks 2 have for dimensions 14×20×13.5 cm. There is thus formed a corner between two walls of 14 cm width.

The starting point is usually a layer of solid blocks 40 which are assembled in the conventional way by means of mortar 38 and over which is laid a roofing sheet 34. On said roofing sheet is then laid a mortar layer into which is laid a horizontal row of blocks. To lay a block row, it is of very great importance to start from a corner of the wall to be built, In the example as shown in FIGS. 8 to 10, the start of the first row is comprised of a base block 2 which is thus of U-shape with the flanges 5 and 6 thereof facing wall portion $A_1$, as shown in FIG. 9; said corner block is then followed by a new block 2 the overthickness 4 of which is engaged between the free ends of flanges 5 and 6 of said corner block. The row further extends in the direction of arrow 16 with base blocks 1. The first row of wall portion $A_2$ is then laid in the same way as the first row of wall portion $A_1$, by starting also from said corner block by means of a base block 1 the overthickness 4 of which is laid against flange 5 of the corner block, the flanges of said block 1 thus being directed along the laying direction for the first row in wall portion $A_2$, as shown by arrow 16. Said block 1 is then followed by a series of blocks 1 which are laid in the same way as the first block 1. A block 2 allows to adjust the end of said first row.

The corner block of the second row is formed by a block 1 which faces wall portion $A_2$ and which is thus anchored in wall portion $A_1$. Said block is then followed in wall portion $A_2$ by a series of blocks 1 the overthickness 4 of which will thus always be anchored between the free ends of flanges 5 and 6, said flanges being directed along the direction of arrow 16.

As may be noted from FIG. 10, said row is terminated by two succeeding blocks 2 the flanges of which are thus always directed along the direction of arrow 16, that is the laying direction for said second row of blocks.

Thereafter occurs the laying of the second row in wall portion $A_1$ by locating the overthickness 4 of a block 1 against the side surface 8 of the corner block which is thus part of wall portion $A_2$. The flanges of said block will be directed along the laying direction for said second row in wall portion $A_1$. As for the other rows, there are then laid again blocks 1, always laid in the same way and terminating the row with a block 2.

The third row in wall portion $A_1$ is laid by starting with a block 1, the flanges 5 and 6 thereof being directed along the direction of said wall portion. Said row is then completed with a series of blocks 1 and terminated by two succeeding blocks 2. Both said blocks 2 and blocks 1 are thus anchored together by means of the overthickness fitted between the free ends of the flanges of the preceding block.

To form the third row in wall portion $A_2$, use is first made of a block 2 the overthickness 4 of which is laid against the surface 8 of the corner block 1 that extends in row 3 of wall portion $A_1$ and said row is then completed with base blocks 1 which are anchored together.

To form the fourth row, the start is the same as for the first row.

It is thus noted that the same block combination is obtained every third row at the corner of two wall portions.

Such a specific arrangement of the block set as shown in FIG. 1 thus allows to form a series of vertical shafts which are connected together by slanting channels in parellel relationship, the channel slanting being shown by arrows 22. As it may be noted from FIG. 10, in that shaft located at the corner, a channel already starts from the second row. The second channel starts from the fifth row and the following channels start from the upper row. It is thus noted that a channel starting from the top row in six block rows goes through six succeeding shafts.

Moreover by means of such a peculiar laying method, there results the formation below a hollow space 10 in a block 1, of two steps defined by flanges 5 and 6 of the blocks from the two rows lower down.

As regards the corner proper, care should be taken to locate the blocks in such a way as to obtain on the one hand a sufficient joining between both wall portion forming said corner and on the other hand, a horizonal cross-section for the vertical shaft as small as possible but large enough to let the binder fall down under the weight thereof, said shaft being open sidewise at least every third towards a slanting channel to let the binder as it falls through said corner shaft, escape partly by overflowing, essentially under the weight thereof, towards the adjacent shaft or shafts which are not yet filled, with a speed and a flow rate which are equal at most to the allowable speed and flow rate as determined by the block pressure strength.

When considering for instance FIGS. 9 and 10, it is noticed that when concrete is poured in hollow space 10 of the corner block in the sixth row, it is possible to fill simultaneously both first channels in wall portion $A_1$ and wall portion $A_2$, said channels being formed by a series of hollow spaces 10 in blocks 1 which are arranged stepwise and through which passes one and the same arrow 22.

The filling with binder extends in this way by succeeding overflowings from the corner block in the sixth row down to the third block in the first row of each one of wall portions $A_1$ and $A_2$.

A special way to obtain the arrangement as shown in FIGS. 8 to 10 lies according to the invention, in locating the base blocks 1 into rows on top of one another in such a way that the flanges 5 and 6 of said blocks be facing in the same direction for one and the same wall portion and that a specific block in a row be set back relative to that block it bears on mainly in the preceding row over a distance which is substantially equal to the length of the flanges 5 and 6 of said block in said row, the blocks 2 of the second base type being essentially used for starting walls or wall portions to allow adjusting the laying of the blocks of the first type in the above-described way and at the end of the wall or wall portion to terminate same substantially vertically.

What matters most when using the block set as shown in FIG. 1 is the formation from each corner of a stairway defined by flanges 5 and 6 of blocks 1 in the one row with the blocks in the lower row and this along the direction of arrow 16. After laying a number of block rows on top of one another, for example six rows as shown in FIGS. 9 and 10, the binder, notably concrete, is poured into the hollow spaces 10 and possibly the space 9 between flanges 5 and 6 of the upper block row.

In this respect, it is of great importance to be able to observe the concrete flow through the hollow spaces of the top row. It is consequently easy to notice the possible cloggings in the channels caused for instance by a concrete agglomerate. In such a case it is but required to dismantle that wall portion where said clogging has occured.

To make easier the description of the concrete pouring in those wall portions $A_1$ and $A_2$ as shown in FIGS. 8 to 10, the various blocks under construction have been designated by a reference numeral.

The binder pouring thus begins with corner c. As already mentioned above, the binder flows simultaneously into both wall portions $A_1$ and $A_2$, among others by means of the anchoring blocks 1 which are part of both wall portions, such as blocks $b_1$, $c_1$, $e_1$ and $f_1$ and which insure the connection of said wall portions. When the binder is poured into block $f_1$, said binder first falls through block $a_1$ and as soon as same is filled, overflows through hollow space 10 of block $b_1$, along a slanting channel as shown by arrow 22 into hollow space 10 of block $a'_2$ and said hollow space as well as the one of block $b_1$ is filled. After filling hollow space 10 of block $b_1$, the binder overflows through hollow space 10 of block $c_1$ into hollow space 10 of block $b_2$ to first fill space 9 of block $a_2$ and then overflow into hollow space 10 of block $a_3$ to then fill hollow space 10 of block $b_2$ and the one of block $c_1$. Blocks $d_1$ and $d_2$ are filled simultaneously with the binder overflowing then through hollow space 10 of block $e_1$ into that channel formed by said space 10 and the ones of blocks $d'_2$, $c'_3$, $b'_2$, $a'_3$. First of all the spaces 9 in the blocks $c'_2$, $b_1$ and $a'_2$ are filled in sequence by succeeding overflowings and then occurs the succeeding filling of the hollow spaces 10 of the blocks that determine said channel at the moment where the binder has filled the hollow space 10 in block $e_1$, said binder overflowing into that channel determined in wall portion $A_1$ by hollow spaces 10 in blocks $f_1$, $e_2$, $d_3$, $c_2$, $b_3$ and $a_4$ to fill same in the above-described way.

When hollow space 10 of block $f_1$ has been filled, it is thus noticed that the binder extends down to block $a_4$ in wall portion $A_1$ and down to hollow space 10 in block $a'_3$ of wall portion $A_2$. At this moment, it is possible either to go on with the filling of wall portion $a_1$ by passing to hollow space 10 of block $f_2$ to fill that slanting channel beginning there, or to go on with the filling of wall portion $A_2$ by passing to hollow space 10 of block $f'_3$ to fill that channel reaching said hollow space. It is thus noticed that once the filling of the corners has been completed, the filling of other parts of wall portions $A_1$ and $A_2$ occurs precisely along the direction of those arrows 22 showing the channel slanting. Consequently, when pouring binder into hollow space 10 of block $f'_4$ in wall portion $A_2$, at the moment where it is noticed that said hollow space fills up, it is automatically known that such filling extends down to hollow space 10 of block $a'_5$. Said filling can be followed by observing the concrete flow through the spaces 9 and hollow spaces 10 of the following blocks in the top row and even through that hollow space through which the pouring is made. It is also noticed that when a channel is filled up, there is obtained the formation of a stairway below the following hollow spaces of the blocks in the top row into which binder has still to be poured.

In FIG. 9 has been shown diagrammatically the development of the filling inside that channel reaching hollow space 10 of block $f_3$. The pouring is performed by means of a concrete pump which has preferably a flow rate from 10 to20 $m^3/h$, which is mounted on a truck and which is provided with a movable arm which allows bringing the end of a hose 19 connected to the pump, above the hollow space to be filled. To avoid binder flowing along the outer surface of the walls, a funnel- shaped trough 45 is preferably arranged over the top row, to guide the binder towards the hollow space to be filled. This is particularly important in the case of relatively narrow walls.

Said trough is slid as the pouring goes on, along the wall in the direction shown by arrow 16. When the filling of some peculiar channel is started, it is noted that the binder does fall directly between the flanges 5 and 6 into that space 9 provided therebetween, for the blocks in the two preceding rows, that is the fourth and fifth rows. Thus due to said relatively low fall height, that space also very small which is bound by said flanges and the surface 13 of the following block, as well as due to the reinforcement both of said flanges and said surface, any danger of block breaking is avoided during the pouring. Moreover there is no danger that blocks move during the pouring as the binder does fall directly but into the spaces 9 of those blocks the hollow spaces 10 of which have already been filled during the filling of a preceding channel. Those blocks into which binder falls directly are thus already integral with the wall. This explains among other things the reason why the blocks do not have to be shored up by some shuttering or similar means during the binder pouring. It is noted that when using base blocks 1, the binder does fall directly but into blocks which are made fast over $\frac{2}{3}$ of the length thereof in the wall due to a preceding pouring.

Concretely, it is noticed that when filling that channel reaching to hollow space 10 of block $f_3$, the binder 17 first falls directly between the flanges of blocks $e_3$ and $d_4$ the hollow spaces 10 of which have already been filled through the hollow space 10 of block $f_2$. After filling the space 9 which is bound by the flanges of said blocks, the binder overflows to first fill in sequence the spaces 9 of the blocks in the lower rows which are arranged step-like with a turbulent movement similar to a cascade. The sequence filling of the hollow spaces 10 in the slanting channel proper then occurs.

The free fall of the binder into the spaces 9 between the flanges 5 and 6 of the blocks $e_3$ and $d_4$ results in the binder inside hollow space 10 of blocks $f_3$ and $c_3$ being vibrated and consequently compressed. During the progression of the concrete pouring inside hollow space 10 of block $f_3$, a small amount of binder accumulates above said spaces 9 while another part fills the following spaces 9 in the blocks $c_3$, $b_4$, and $a_5$ by causing in the same way a vibrating action on the binder inside the hollow spaces 10 of the lower blocks. The remainder of the poured binder accumulates first above said spaces 9 and fills then, with a somewhat turbulent movement along a zigzag direction the hollow spaces 10 of blocks $a_6$, $b_5$, $c_4$, $d_5$, $e_4$ and $f_3$. Due to the stairway shape of the channel, a slowing down of the binder pouring is obtained as well as a limitation of the binder flow rate, which allows avoiding the cracking of the side surfaces 7 and 8 bounding the hollow spaces 10.

It is important to underline the vibrating action on the binder inside the channels. Said vibrating is on the one hand sufficiently strong to cause settling of the binder in the hollow spaces and on the other hand it is not strong enough to cause cracking of the blocks. In this respect, it is to be noted that the binder does not undergo any substantial acceleration during the down movement thereof.

Moreover it is noted that according to the invention, the binder vibrating inside some particular hollow space occurs in two steps. When considering for example hollow space 10 in block $a_6$, it is noted that a first vibrating occurs on the left-hand portion of that binder mass contained inside said hollow space by means of that binder filling hollow space 10 in block $b_5$. The air which is possibly contained inside the concrete mass that fills hollow space 10 of block $a_6$ can easily escape through that space 9 not yet filled in block $b_5$ as shown by arrow 50. During the second step, the vibrating is caused in that same hollow space 10 of block $a_6$ due to the fall of the binder inside space 9 of block $b_5$ during the binder pouring into hollow space 10 of block $f_4$.

The pressure inside some particular hollow space is thus always exerted on relatively small areas in such a way that the total force which is exerted on the binder mass inside a hollow space always remains small also.

The situation can be somewhat different adjacent the corners, as it is clear from the FIGS. 9 and 10 and from the above considerations. In such locations the binder braking mechanism, mostly at the start of the pouring, can be determined for the most part by the friction resistance of the binder on the block walls. It may thus be of importance to provide in such locations a maximum amount of crosswise walls per unit of volume. This is obtained automatically when making use of blocks 2 of "U" shape.

When considering the path followed by binder 17 inside a channel formed in rows of superposed blocks, it is noted that said channel has narrow portions shown in 18, that is between two succeeding rows, in front of the lower edge of the cross-wise wall 11 of blocks 1. Due to the presence in this location of recess 12, the danger of clogging is substantially lowered for the binder of the downwards movement thereof.

When now considering wall 13 of a block 1 used for making a wall, it is noted that said wall lies above wall 11 of a block 1 in the preceding row.

To avoid that for example due to some irregularity of one of the blocks, a crack might remain between both said superposed walls, which crack would not be filled with binder, a recess 15 has been provided for insuring the filling with binder of any void between the edges of both said walls during the binder pouring into those channels formed inside walls or wall portions.

There is thus obtained a really complete filling of all the voids which are present inside a wall made from said blocks.

The blocks are thus generally laid with recesses 12 and 15 facing downwards.

Another important feature of the method according to the invention lies in forming continuous binder columns inside the vertical shafts, in succeeding layers, by means of the slanting channels which connect and cross said vertical shafts. During the binder pouring in a particular channel, the air is expelled continuously at succeeding levels through the upper portions of the shafts through which pass said channels and which are not yet filled with binder.

The columns thus obtained and which are joined together can insure by themselves the rigidity of the resulting walls, in such a way that the blocks used might possibly be considered as a simple shuttering without any bearing function.

To terminate a wall portion adjacent a window or door opening, use is made of a "U"-shaped shuttering 33 as shown in FIG. 8. Said shuttering thus lets the dimensions of the opening be fixed accurately independently from the block size.

With a combination of blocks 1 and 2 somewhat similar to the combination used for a wall corner, the wall portion is terminated with superposed flanges 5 and 6 facing inside the shuttering 33 to form therewith also a vertical shaft 39 inside which the binder can be poured. Small wood blocks (not shown) can be fastened beforehand to the shuttering, for the fastening of the window or door frame.

Independently from the relative position of the opening in the wall and the opening size, the spacing from the terminal blocks to wall 27 of the shuttering is always shorter than the flange length of a block. Care should be taken that the side walls 24 and 25 of the shuttering extend farther out than the flanges 5 and 6 to allow clamping said shuttering for instance by means of screw-clamps (not shown) to the terminal blocks without any danger of breaking said blocks.

Figure 16:
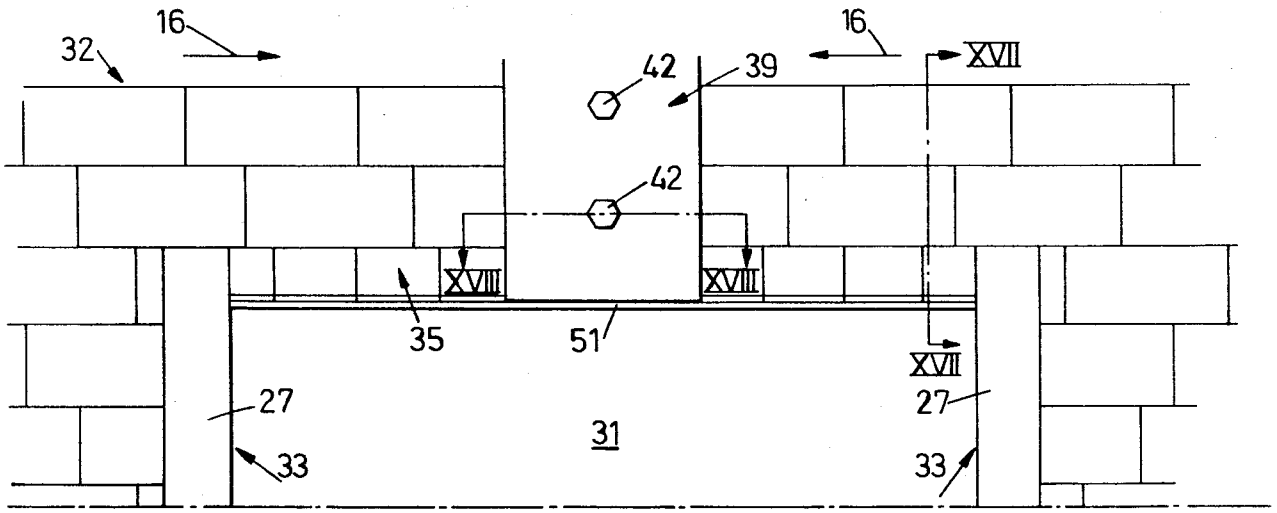
FIG. 16 is an elevation view with parts broken away of a wall provided with a door opening.

FIGS. 16 to 18 show more concretely the formation of a wall in which is provided a door or window opening 31. As shown in FIGS. 8 to 10, it is required to build a wall to start from both corners thereof by directing the block flanges in a wall portion towards the opposite corner thereof. There is thus formed two wall portions similar to wall portions $A_1$ and $A_2$ in FIGS. 8 to 10 which terminate some distance away from one another, which distance is shorter than the length of flanges 5 and 6. The ends of said portions facing one another are joined together by means of a shuttering 39 comprising two panels 40 and 41 which are applied on either side against the facing ends of both wall portions so as to form between said portions and the panels a shaft 28 into which the binder can flow (see FIG. 18).

Panels 40 and 41 are clamped against the blocks through bolts 42 which extend through a tube 43 which remains imbedded in the binder after removing the shuttering.

To the other surface of panel 40 is fastened a nut 44 in which can be screwed bolt 42. To remove shuttering 39, it is thus but necessary to loosen the various bolts 42.

The side surfaces of opening 31 are finished by means of a shuttering 33 as described when referring to FIGS. 8 to 10.

For an opening having some width, a lintel 35 is built thereabove. For this purpose, a horizontal timber 51 is for example laid between both shutterings 27, which determines the height of opening 31. The lintel is formed by means of blocks 2 which are arranged in rows one against the other, in such a way that the backs 13 of said blocks will lie below and the flanges will be facing upwards, when starting from each opening side. Consequently the spaces 9 between the flanges determine two continuous gutter portions. In said gutter is laid a reinforcement 36 which projects on both outer ends, for instance over 10 cm.

To form beams with a substantial thickness, use can be made of special "U"-shaped blocks the flanges of which are longer or else, a side shuttering can be so arranged on either side of said blocks as to project relative to the flanges.

After laying the reinforcement 36, it is possible either to fill the gutter with the binder, notably concrete 17, or to go on with the laying of wall portions on either side of opening 31 towards one another and above lintel 35 and then joining said wall portions together with both gutter portions by means of a shuttering 39 as described above.

When pouring the binder into the top row of both wall portions, the gutter of lintel 35 is then also automtically filled. Thus the blocks laid above the gutter can in some way be considered as being part of the lintel.

It must be understood that said lintel can be made separately and after hardening of the binder poured into the gutter, be located above opening 31.

To have the flange ends of those blocks 2 forming the gutter for lintel 31 lie in the plane of the upper surface of a block row from the wall portions lying on either side of opening 31, it is preferred to adapt the height of blocks 40 from which the building is started by means of the blocks according to the invention (see FIGS. 9 and 10).

FIGS. 11 to 15 relate to particular examples of joining blocks in the set as shown in FIG. 1.

FIG. 12 shows the formation of a T-junction between a wall 52 with a normalized thickness of 14 cm and a wall 53 having a normalized thickness of 19 cm.

It might possibly be useful as shown in FIG. 12, to make use of two different types of blocks 2 of "U" shape both for the 14 cm-wide blocks and the 19 cm-wide blocks.

The blocks 2 with shortened flanges might possibly be dispensed with and replaced by a shuttering as the number of such blocks is very low and they are simply superposed adjacent the junctions of wall portions.

Figure 14:
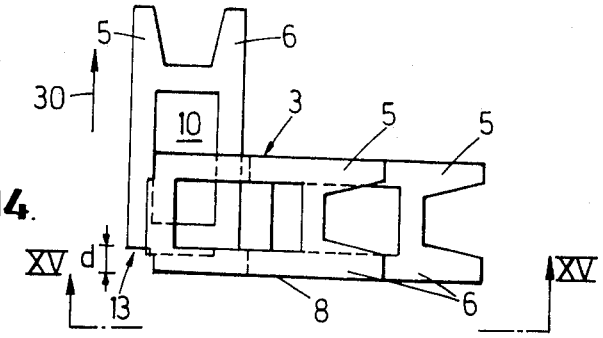
FIG. 14 is a plan view of another specific embodiment of a corner assembly with a building block set according to the invention.
Figure 15:
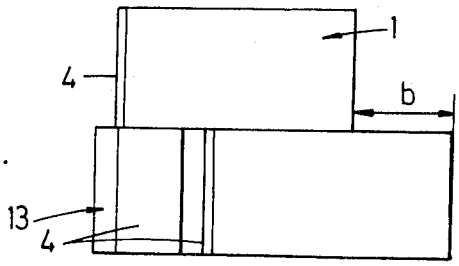
FIG. 15 is a view along line XV-XV in FIG. 14.

FIGS. 14 and 15 relate to the formation of a corner or right-angled junction between two walls, for instance by means of blocks 1 the length of which is slightly shorter than three times the width thereof. In such a case, there is formed a right-angled corner with blocks 1 and 2 by directing the flanges 5 and 6 thereof outwards relative to the corner and by bringing forward the wall 13 of the one block along the direction of said flanges, as shown by arrow 30, relative to the outer side surface 8 at the corner of the other block over a distance d which should be at the most substantially equal to the thickness of the wall of trapezoidal portion 3 of blocks 1.

When use is made of blocks the flange length of which is substantially equal to half the length of trapezoidal portion 3 of block 1, said laying method for the blocks is also to be applied in that case where the width of the blocks used would be longer than the flange length thereof.

This explains somewhat thus the fact that the tolerance in the length of the blocks and in the ratio of two lengths of one and same block may possibly have a value which is equal to the wall thickness of the blocks. Due to said tolerance, it is possible to make an assembly of superposed blocks of type 1 with a minimum number of blocks of type 2 having different sizes.

As it may be noted from FIG. 15, this way of laying the blocks at the start from a corner allows to set back a block in one row relative to the block in the preceding row over a distance b which is substantially equal to the flange length of said block.

Figure 11:
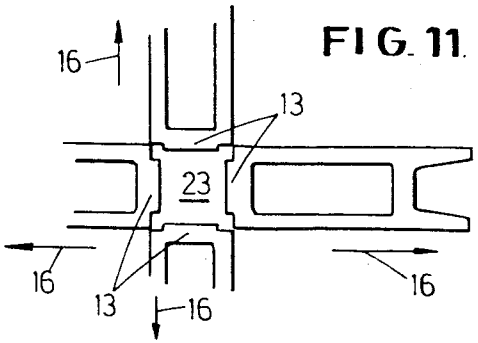

FIG. 11 relates to a particular arrangement of the blocks for starting a junction between two walls crossing at right angle.

In this respect in the wall crossing location an area 23 is bounded by four blocks the walls 13 of which are arranged along the sides of a square in the case where both walls have the same thickness or the sides of a rectangle in the case where the walls have different thicknesses, and this in such a way that the flanges face the outside of area 23 in the direction of the walls.

A feature of the invention lies in filling first when a series of blocks have been superposed, the ends of the wall portions thus obtained which bound said area 23, and in pouring binder in said area 23 but after those four wall portions bounding said area have been filled.

Figure 13:
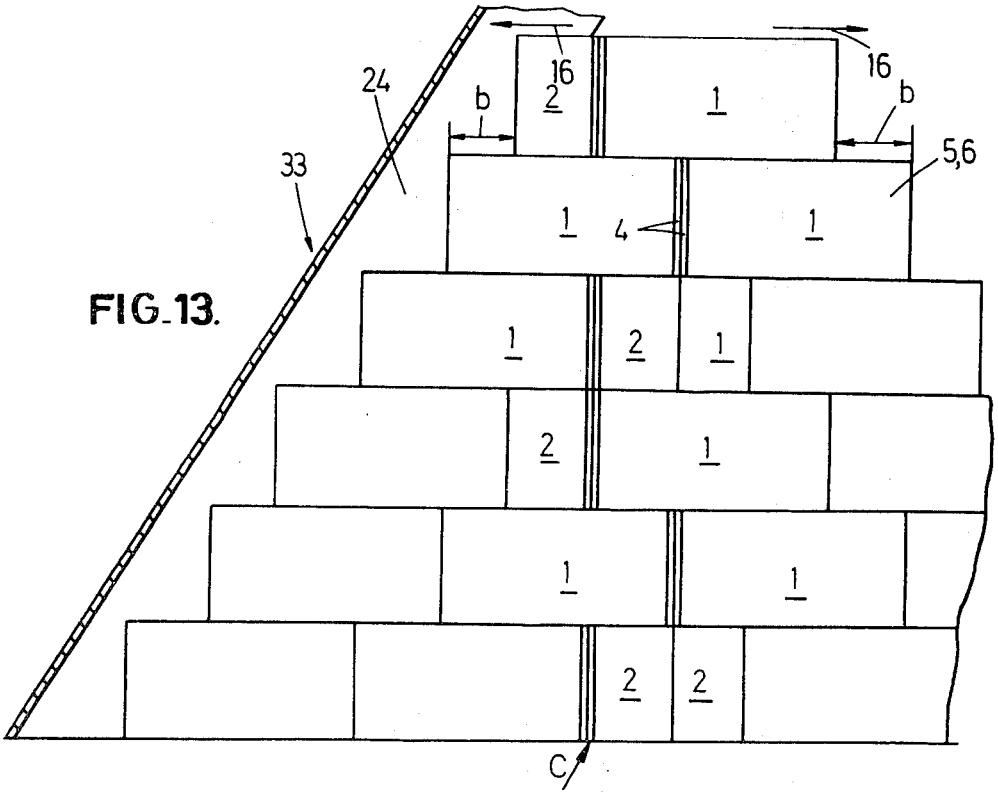
FIG. 13 is an elevation view with parts broken away of two wall portions connected together in extension of one another.

FIG. 13 relates to still another embodiment of the method according to the invention as applied to the building of a gable-end or of wall portions lying between two openings, for instance window or door openings. In such a case, a starting point c is selected for example approximately half-way of the gable-end base or the spacing between both openings and two blocks are so laid relative to said starting point, that the flanges thereof face the opposite direction relative to said starting point.

Such a construction may actually be considered as a corner of two walls lying at 180° to one another in said starting point c. In this way the block arrangement as shown in FIG. 13, may be compared to the arrangement shown in FIGS. 9 and 10 relating to two wall portions lying at 90° to one another.

As it may be noted to obtain the block arrangements as shown in FIG. 13, it is theoretically but necessary to wing the one wall portion of FIG. 5 in the plane of the other wall portion.

There results from the above that it is generally possible to consider as the start of a wall or wall portion, a wall corner at 90° or said location.

Consequently by wall portion there is meant here the assembly of blocks which have been laid by starting from such a corner and which have then be filled in a single operation with a binder while by laying direction 16 of the blocks there should be understood generally the horizontal direction from a point defined in such a way in the wall portion plane towards the portion end.

To form an expansion joint between two wall portions lying in the extension of one another, it is possible to provide in that shaft formed between said portion and bounded by shuttering 39, over the whole height thereof, a compressible element the width of which is substantially equal to the wall width. This is mostly important when building industrial buildings such as sheds, having continuous walls of substantial length.

Moreover it is possible to arrange both in the vertical shafts and in the slanting channels, a metal reinforcement before pouring the binder. This may be of importace mostly when erecting buildings of some height and also to make structures which withstand earthquakes.

FIG. 19 is a plan view of a rectangular enclosure made by means of walls built with the method according to the invention. Substantially half-way along each wall is provided a reinforced-concrete column 49 which has been made with a shuttering such as shuttering 39 as described above with reference to FIG. 16. Said columns are thus anchored in the wall portions abutting same. The top ends of said columns are joined together by a four-sided reinforcement 46, said reinforcement being completed by a horizontal reinforcement 47 the ends of which are anchored in the wall shafts to obtain a reinforced-concrete floor supported by said four walls.

As results from the above, the work is performed stepwise when erecting a wall of substantial height, that is the block filling with the binder is made after laying a selected number of blocks rows, for example six. After such filling a new series of blocks rows is laid on the filled rows and a new binder pouring is made. To insure anchoring between two superposed wall portions which have been filled separately, it is for example possible to limit the filling of the blocks in the top row for each portion. Another solution lies in providing a mortar layer between two succeeding portions. An efficient joining of two portions can be obtained in this latter case by driving lengths of iron rod into the concrete of the last row, which lengths so project as to be anchored in the first row of the following wall portion.

The ideal fluidity for the binder notably concrete, as well as the particle size thereof can easily be determined experimentally according to the required filling and the size of the hollow spaces provided in the blocks.

It has been noted that concrete comprising 800 liters gravel (size: 2/8), 400 liters sand and 350 kg cement gives good results as regards both the rigidity and the possibility of filling the block hollow spaces.

The block composition may vary substantially according to the nature of the building to be erected and the requirements thereof.

When the blocks are to be used for erecting bearing walls, the filling concrete should have relatively good mechanical properties and should possibly be capable of bearing the full load. In such a case the blocks can be considered as a simple shuttering and should only be self-bearing. In this case the blocks can for instance be made from a heat-insulating material. It is also possible to use a binder which has good heat properties; in such a case the blocks could be made from a material with good mechanical properties.

Generally speaking the blocks can be made from heavy or light concrete, clay-based expanded concrete or even a synthetic material having for instance good insulating properties.

The block sizes could of course also vary substantially.

When relatively large blocks are used, it might be useful in some cases to provide in hollow space 10 a lengthwise partition. Said partition might give the advantage of increasing the block rigidity, lowering the amount of binder required and when the block is made from a heat-insulating material, of increasing the insulating properties of a wall made from such blocks. This shows the advantage of using a block has shown in FIG. 7.

It might also be useful when the blocks have relatively long flanges to provide therebetween a reinforcement cross-tie to prevent breaking said blocks when conveying same. Said cross-tie could then easily be removed on the building site before laying the blocks.

The "U"-shaped blocks 2 can be suitable for building separate columns. It is only necessary in such a case to lay such blocks two by two by arranging the flange ends of one block against the flange ends of the other block.

To make conveying and handling of the "U"-shaped shutterings 33 easier, such shutterings can be made from three parts hinged together, for example by means of a continuous flexible strip from synthetic material such as polyethylene 26, as shown in FIG. 8. The height of blocks 1 is advantageously substantially equal to half the width thereof.

It must be understood that the invention is in no way limited to the above embodiments and that many changes can be brought therein without departing from the scope of the invention as defined by the appended claims.

I claim:

1. A wall construction comprising superimposed rows of hollow blocks into which binder, for example concrete, has been poured, said construction including two forms of block, a first form of block having cross walls and side walls which define a straight, rectangular parallelipiped which has a hollow volume extending through the whole height of the block, the side walls being extended at least at one end by two flanges whose length is a fraction of the length of the parallelipiped thereby defining a hollow volume which is short relative to the long hollow volume of said parallelipiped, and a second form of block of U-shaped horizontal cross-section having a cross wall and flanges whose outer surfaces are co-planar with the outer surface of the flanges of the first form of block, the blocks being positioned so that in each row long and short ones of said hollow volumes alternate and in successive rows the cross walls of each row, except the lowermost, are displaced horizontally relative to the cross walls of the next lower row by a distance of the order of the length of one of said short hollow volumes, said displacements in the consecutive rows being in the same direction towards one end of the wall construction, whereby both vertical shafts and slanting channels exist between said hollow volumes which facilitate the flow of said binder through said hollow volumes during said pouring.

2. A wall construction according to claim 1, wherein the hollow rectangular parts of the first type of blocks define the long or the short hollow spaces, and the U-shaped parts formed by flanges extending away from one end of those rectangular parts define the others of the hollow spaces.

3. A wall construction according to claim 2, wherein the other end of the hollow, rectangular part is formed by an overthickness which fits between the flanges of an adjacent block.

4. A wall construction according to claim 1, wherein at least some of the blocks of the first type have, in horizontal cross-section, a hollow rectangular part defining one of said hollow spaces, and at each end of the rectangular part a U-shaped part formed by flanges extending away from the rectangular part.

5. A wall construction according to claim 2, or claim 4, wherein the hollow rectangular part defines a long hollow space and the or each U-shaped part defines a short hollow space.

6. A wall construction according to claim 1, wherein the total length of the block is substantially equal to three times its width.

7. A wall construction according to claim 1, wherein the blocks of the second type which are of U-shaped horizontal cross-section are each formed by a cross wall and two flanges which are similar to the flanges of the blocks having a hollow, rectangular cross-section.

8. A wall construction according to claim 7, including U-shaped blocks whose flanges are of different lengths.

9. A wall construction according to claim 7, wherein the cross wall of the U-shaped block has an overthickness which fits between the flanges of an adjacent block.

10. A wall construction according to claim 7, wherein the length of the U-shaped block is equal to the difference between the length of the rectangular part and the width of a block having a hollow rectangular part.

11. A wall construction according to claim 7, wherein the length of the U-shaped block is equal to the difference between the length and the width of a block having a hollow rectangular part.

12. A wall construction according to claim 7, wherein the length and width of the U-shaped block are the same.

13. A wall construction according to claim 1, wherein on edge of each cross wall of each block is formed with a recess.

14. A wall construction according to claim 1, in which cross-wise slots are formed in the edge of the side walls of at least some of the blocks.

15. A wall construction according to claim 1, wherein the inner corners of the hollow space in each block are reinforced.

16. A wall construction according to claim 15, wherein the thickness of the side walls of each block increases towards the corners of the hollow space defined in said block in order to reinforce the corners.

17. A wall construction according to claim 1, wherein the hollow spaces form slanting channels through the wall which channels are at an angle of 50° to 60° to the horizontal.

18. A wall construction according to claim 1, comprising two series of rows of blocks extending towards each other from each corner of the wall, and shuttering panels fastened against the side faces of adjoining ends of the blocks of the two series, to bridge any gap between those adjoining ends.

19. A wall construction according to claim 18, wherein the shuttering panels are clamped to the blocks by fasteners passing through the wall.

20. A wall construction according to claim 18, including a compressible element located between the adjoining ends of the two series of rows of blocks to form an expansion joint.

21. A wall construction according to claim 1, including a door or window opening in the wall, the sides of which opening are bounded by U-shaped shuttering through which the binder can be pumped.

22. A wall construction according to claim 1, including reinforcement arranged in vertical shafts and slanting channels formed in the wall by said hollow spaces.

23. Wall construction according to claim 1 wherein the rows of blocks are dry-laid.

* * * * *